US011433405B2

(12) United States Patent
Lin et al.

(10) Patent No.: US 11,433,405 B2
(45) Date of Patent: Sep. 6, 2022

(54) WATER OUTLET DEVICE AND DRIVING MECHANISM FOR WATER OUTLET DEVICE

(71) Applicant: Xiamen Solex High-Tech Industries Co., Ltd., Xiamen (CN)

(72) Inventors: Fengde Lin, Xiamen (CN); Wenxing Chen, Xiamen (CN)

(73) Assignee: Xiamen Solex High—Tech Industries Co., Ltd., Xiamen (CN)

( * ) Notice: Subject to any disclaimer, the term of this patent is extended or adjusted under 35 U.S.C. 154(b) by 377 days.

(21) Appl. No.: 16/712,972

(22) Filed: Dec. 12, 2019

(65) Prior Publication Data

US 2020/0188940 A1 Jun. 18, 2020

(30) Foreign Application Priority Data

Dec. 12, 2018 (CN) ..... 201811517500.7

(51) Int. Cl.
*B05B 1/16* (2006.01)
*B05B 1/18* (2006.01)

(52) U.S. Cl.
CPC ..... *B05B 1/1636* (2013.01); *B05B 1/185* (2013.01)

(58) Field of Classification Search
CPC ..... B05B 1/16; B05B 1/1627; B05B 1/1636; B05B 1/1681; B05B 1/169; B05B 1/18; B05B 1/185; B05B 12/002
See application file for complete search history.

(56) References Cited

U.S. PATENT DOCUMENTS

| | | | | |
|---|---|---|---|---|
| 5,433,384 | A * | 7/1995 | Chan | B05B 1/1636 239/239 |
| 8,113,442 | B2 * | 2/2012 | Li | B05B 1/1636 239/443 |
| 9,394,259 | B2 * | 7/2016 | Zhou | B05B 1/1636 |
| 9,427,749 | B2 * | 8/2016 | Zhou | B05B 1/1636 |
| 9,829,116 | B2 * | 11/2017 | Xu | F16K 11/074 |
| 9,901,939 | B2 * | 2/2018 | Lin | B05B 1/185 |
| 9,950,327 | B2 * | 4/2018 | Lin | B05B 1/1636 |
| 10,046,339 | B2 * | 8/2018 | Zhou | B05B 1/1636 |
| 2013/0247294 | A1 * | 9/2013 | Zhou | B05B 1/185 4/615 |
| 2017/0100728 | A1 * | 4/2017 | Gong | B05B 1/18 |
| 2017/0120264 | A1 * | 5/2017 | Lin | B05B 15/65 |
| 2017/0136473 | A1 * | 5/2017 | Yu | A47K 3/28 |
| 2020/0001314 | A1 * | 1/2020 | Yang | A47K 3/28 |

* cited by examiner

*Primary Examiner* — Darren W Gorman
(74) *Attorney, Agent, or Firm* — Cooper Legal Group, LLC

(57) ABSTRACT

The present disclosure discloses a water outlet device comprising a body. The body comprises a driving mechanism, a switching mechanism, and a plurality of water outlet parts. The switching mechanism is coupled with the plurality of water outlet parts to control switching of the plurality of water outlet parts. The driving mechanism comprises an operating member and a directional control mechanism. The operating member is movably connected to the body, and the operating member is connected to the directional control mechanism. Bidirectional movements of the operating member respectively controls the directional control mechanism to move in a single direction. The directional control mechanism is connected to the switching mechanism and configured to drive the switching mechanism to control switching of the plurality of water outlet parts.

22 Claims, 13 Drawing Sheets

WATER OUTLET DEVICE AND DRIVING MECHANISM FOR WATER OUTLET DEVICE

RELATED APPLICATIONS

This application claims priority to Chinese Patent Application 201811517500.7, filed on Dec. 12, 2018. Chinese Patent Application 201811517500.7 is incorporated herein by reference.

FIELD OF THE DISCLOSURE

The present disclosure relates to the field of bathroom fixtures, and in particular to a water outlet device and a driving mechanism for the water outlet device.

BACKGROUND OF THE DISCLOSURE

Chinese Patent Application CN102728506A discloses an automatic return switching device comprising a body, an upper cover rotatably coupled to the rear side of the body, a driven disc rotatably coupled between the rear side of the body and the upper cover, a clutch mechanism, and a reset device. The body comprises a water-separating device. The clutch mechanism comprises a bidirectional ratchet and a bidirectional lever that cooperates with the bidirectional ratchet. The bidirectional ratchet is rotatably coupled to the rear side of the body and is connected to the water-separating device such that rotation of the bidirectional ratchet drives the water-separating device to switch. The bidirectional lever and the upper cover are connected to the driven disc to drive the bidirectional lever to move between a forward position, a reverse position, and a disengagement position by the rotation of the upper cover relative to the driven disc. When the bidirectional lever is in the forward position, the upper cover rotates in a forward direction to drive the bidirectional ratchet forward, and the ratchet drives the water-separating device to rotate forward to realize switching. When the bidirectional lever is in the reverse position, the upper cover rotates in a reverse direction to drive the bidirectional ratchet to reverse, and the ratchet drives the water-separating device to rotate in a reverse direction to realize switching. The automatic return switching device can only realize resetting. The forward rotating upper cover drives the water-separating device to rotate forward, and the reverse rotating upper cover drives the water-separating device to rotate in reverse, which makes the switching inconvenient.

BRIEF SUMMARY OF THE DISCLOSURE

The present disclosure provides a water outlet device to solve deficiencies of the existing techniques.

In order to solve the aforementioned technical problems, the present disclosure provides a water outlet device, comprising a body. The body comprises a driving mechanism, a switching mechanism, and a plurality of water outlet parts. The switching mechanism is coupled with the plurality of water outlet parts to control switching of the plurality of water outlet parts. The driving mechanism comprises an operating member and a directional control mechanism. The operating member is movably connected to the body, and the operating member is connected to the directional control mechanism. Bidirectional movements of the operating member respectively controls the directional control mechanism to move in a single direction, and the directional control mechanism is connected to the switching mechanism and configured to drive the switching mechanism to control switching of the plurality of water outlet parts.

In a preferred embodiment, the operating member is configured to rotate relative to the body.

In a preferred embodiment, the directional control mechanism comprises a rotating part, a swinging part, and a transmission part. The rotating part is connected to the operating member, and a middle part of the swinging part is configured to swing relative to the body. The rotating part comprises a forward abutting part and a reverse abutting part. The reverse abutting part is coupled to the transmission part. When the rotating part is rotated in a reverse direction, the reverse abutting part abuts the transmission part, the forward abutting part abuts a first end of the swinging part, and a second end of the swinging part is coupled to the transmission part, and when the rotating part is rotated in a forward direction, the forward abutting part abuts the swinging part and the swinging part abuts the transmission part.

In a preferred embodiment, the rotating part is disposed with an arc-shaped through groove disposed around an axis of rotation of the rotating part, and a swinging shaft of the swinging part passes through the arc-shaped through groove.

In a preferred embodiment, an intermittent movement mechanism is disposed between the directional control mechanism and the switching mechanism.

In a preferred embodiment, the switching mechanism comprises a switching seat configured to rotate relative to the body, and the intermittent movement mechanism is connected to the switching seat to drive the switching seat to rotate to control the switching of the plurality of water outlet parts.

In a preferred embodiment, the switching mechanism comprises a switching seat configured to rotate relative to the body. The intermittent movement mechanism is connected to the switching seat to drive the switching seat to unidirectionally rotate at a preset angle to control the switching of the plurality of water outlet parts.

In a preferred embodiment, the intermittent movement mechanism comprises a driving wheel and a driven wheel. The directional control mechanism is connected to the driving wheel, the driving wheel is connected to the driven wheel, and the driven wheel is connected to the switching seat.

In a preferred embodiment, a clutch mechanism is disposed between the driving wheel and the driven wheel. When the driving wheel rotates in a reverse direction, the clutch mechanism is engaged. When the driving wheel rotates in a forward direction, the clutch mechanism is disengaged.

In a preferred embodiment, the driving wheel comprises a first ratchet, and the driven wheel comprises a second ratchet. The clutch mechanism is defined by the first ratchet and the second ratchet, and an elastic mechanism connects to the driven wheel or the driven wheel to couple the first ratchet with the second ratchet.

In a preferred embodiment, the intermittent movement mechanism further comprises a retaining mechanism, and the retaining mechanism comprises a stop claw. A peripheral surface of the driven wheel comprises a third ratchet. A first end of the stop claw is rotatably connected to the body, and a second end of the stop claw is coupled with the third ratchet.

In a preferred embodiment, the water outlet device further comprises a reset mechanism connected to the intermittent movement mechanism and the body.

In a preferred embodiment, the water outlet device further comprises a reset mechanism connected to the driving wheel and the body.

In a preferred embodiment, an intermittent movement mechanism is disposed between the directional control mechanism and the switching mechanism. The intermittent movement mechanism comprises a driving wheel, and the driving wheel is fixed relative to the transmission part.

In a preferred embodiment, the driving wheel comprises a wheel body part and a first protrusion protruding from the wheel body part. The directional control mechanism comprises a transmission part fixedly connected to the first protrusion.

In a preferred embodiment, the switching mechanism comprises a switching seat, and each water outlet part of the plurality of water outlet parts disposed with a water-separating hole. Each water-separating hole is disposed with a sealing part configured to move in a first direction relative to the body, and switching of each water-separating hole are controlled by movement of the sealing part. A peripheral wall of the switching seat protrudes outward to define a pushing part. A plurality of sealing parts are circumferentially spaced apart and surround the switching seat. A sealing part of each of the plurality of sealing parts is disposed with a matching part configured to be engaged with the pushing part. When the switching seat rotates, the pushing part follows the switching seat to move circumferentially, and circumferential movement of the pushing part drives a corresponding matching part to move in the first direction. The first direction intersects a vertical plane perpendicular to an axis of rotation of the switching seat.

In a preferred embodiment, the pushing part comprises a guiding surface and a supporting part connected to the guiding surface. The supporting part comprises an inner ring supporting part and an outer ring supporting part arranged radially along the axis of rotation of the switching seat. A central angle of the outer ring supporting part is smaller than a central angle of the inner ring supporting part. The plurality of sealing parts comprises at least a first sealing part and a second sealing part. The first sealing part comprises a first matching part, and the second sealing part comprises a second matching part. A length of the second matching part extending out from the second sealing part is longer than a length of the first matching part extending out from the first sealing part. The second matching part is engaged with the inner ring supporting part and the outer ring supporting part, and the first matching part is only engaged with the outer ring supporting part.

In a preferred embodiment, the supporting part is connected to a top of the guiding surface.

In a preferred embodiment, a first end of the inner ring supporting part is aligned with a first end of the outer ring supporting part.

In a preferred embodiment, the first sealing part is adjacent to the second sealing part. A central angle between the first matching part of the first sealing part and the second matching part of the second sealing part is not larger than the central angle of the inner ring supporting part.

A second technical scheme in the present disclosure to solve the aforementioned technical problems is as follows: a water outlet device, comprising a body. The body comprises a switching mechanism, a driving mechanism configured to drive the switching mechanism, and a plurality of water outlet parts. The switching mechanism comprises a switching seat, and each water-separating part of the plurality of water outlet parts is disposed with a water-separating hole. Each water-separating hole is disposed with a sealing part configured to move in a first direction relative to the body, and switching of each water-separating hole is controlled by movement of the sealing part. A peripheral wall of the switching seat protrudes outward to define a pushing part. A plurality of sealing parts are circumferentially spaced apart and surround the switching seat. Each sealing part of the plurality of sealing parts is disposed with a matching part configured to be engaged with the pushing part. When the switching seat rotates, the pushing part follows the switching seat to move circumferentially, and circumferential movement of the pushing part drives the matching part to move in the first direction. The first direction intersects a vertical plane perpendicular to an axis of rotation of the switching seat. The pushing part comprises a guiding surface and a supporting part connected to the guiding surface. The supporting part comprises an inner ring supporting part and an outer ring supporting part arranged radially along the axis of rotation of the switching seat. A central angle of the outer ring supporting part is smaller than a central angle of the inner ring supporting part. The plurality of sealing parts comprises at least a first sealing part and a second sealing part. The first sealing part comprises a first matching part, and the second sealing part comprises a second matching part. A length of the second matching part extending out from the second sealing part is longer than a length of the first matching part extending out from the first sealing part. The second matching part is engaged with the inner ring supporting part and the outer ring supporting part, and the first matching part is only engaged with the outer ring supporting part.

A third technical scheme in the present disclosure to solve the aforementioned technical problems is as follows: a driving mechanism for a water outlet device comprising a body. The driving mechanism comprises an operating member and a directional control mechanism. The operating member is movably connected to the body, and the operating member is connected to the directional control mechanism. Bidirectional movements of the operating member respectively controls the directional control mechanism to move in a single direction, and the directional control mechanism is connected to the switching mechanism and configured to drive the switching mechanism.

Compared with existing techniques, the technical solution provided by the present disclosure has the following advantages.

The driving mechanism comprises an operating member and a directional control mechanism. The operating member is movably connected to the body, and the operating member is connected to the directional control mechanism. Bidirectional movements of the operating member respectively controls the directional control mechanism to move a single direction. Whether the operating member rotates in the forward direction or in the reverse direction, the directional control mechanism outputs in the unidirectionally, so that a sequence of the switching is in order to facilitate enabling the user to switch to the desired water spray, and the switching is convenient.

The operating member is configured to rotate relative to the body to facilitate an operation of the user.

The directional control mechanism comprises a rotating part, a swinging part and a transmission part. The rotating part comprises a forward abutting part and a reverse abutting part. The reverse abutting part is coupled to the transmission part. When the rotating part is rotated in a reverse direction, the reverse abutting part abuts the transmission part, the forward abutting part abuts a first end of the swinging part, and a second end of the swinging part is coupled to the transmission part. When the rotating part is rotated in a forward direction, the forward abutting part abuts the swinging part and the swinging part abuts the transmission part. The structure is simple and compact, the layout is reasonable, the stability is high, and the operation is convenient.

The rotating part is disposed with an arc-shaped through groove disposed around an axis of rotation of the rotating part, and a swinging shaft of the swinging part passes through the arc-shaped through groove. The arc-shaped through groove provides a mounting space for the swinging part. Further, the arc-shaped through groove is configured to guide and limit the swinging part by a combination of the arc-shaped through groove and the swinging shaft.

The intermittent movement mechanism is disposed between the directional control mechanism and the switching mechanism. The directional control mechanism is combined with the intermittent movement mechanism, so that a stable and reliable unidirectional switching is achieved, and the switching is convenient.

The switching mechanism comprises a switching seat configured to rotate relative to the body, and the intermittent movement mechanism is connected to the switching seat to drive the switching seat to rotate to control the switching of the plurality of water outlet parts. The structure of the switching mechanism is simple and reliable.

The intermittent movement mechanism comprises a driving wheel and a driven wheel. The directional control mechanism is connected to the driving wheel, the driving wheel is connected to the driven wheel, and the driven wheel is connected to the switching seat. The structure is simple and compact.

The clutch mechanism is disposed between the driving wheel and the driven wheel. When the driving wheel rotates in a reverse direction, the clutch mechanism is engaged. When the driving wheel rotates in a forward direction, the clutch mechanism is disengaged. It is easy to be reset, and the structure is simple.

The reset mechanism is connected to the intermittent movement mechanism and the body. The structure is simple.

The water outlet device further comprises a reset mechanism connected to the driving wheel and the body.

The intermittent movement mechanism is disposed between the directional control mechanism and the switching mechanism. The intermittent movement mechanism comprises a driving wheel, and the driving wheel is fixed relative to the transmission part. The connection is stable and reliable, the structure is simple, and assembly is convenient and fast.

The driving wheel comprises a wheel body part and a first protrusion protruding from the wheel body part, and the directional control mechanism comprises a transmission part fixedly connected to the first protrusion. The connection is stable and reliable, the structure is simple, and assembly is convenient and fast.

The unidirectional output of the directional control mechanism output couples to the pushing part of the switching seat of the switching mechanism and the matching part. Effort is reduced, and the switching is convenient.

The supporting part comprises an inner ring supporting part and an outer ring supporting part arranged radially along the axis of rotation of the switching seat. A central angle of the outer ring supporting part is smaller than a central angle of the inner ring supporting part. A length of the second matching part extending out from the second sealing part is longer than a length of the first matching part extending out from the first sealing part. The second matching part is engaged with the inner ring supporting part and the outer ring supporting part, and the first matching part is only engaged with the outer ring supporting part. The switching of single water spray and mixed water spray can be achieved by an arrangement the first sealing part and the second sealing part.

The first end of the inner ring supporting part is aligned with a first end of the outer ring supporting part, so that the arrangement of the first sealing part and the second sealing part is convenient.

BRIEF DESCRIPTION OF THE DRAWING

The present disclosure will be further described below with the combination of the accompanying drawings together with the embodiments.

FIG. 14-1 illustrates a perspective view of an eccentric impeller of the water outlet device of the specific embodiment.

DETAILED DESCRIPTION OF THE EMBODIMENTS

Embodiment 1

Figure 1:
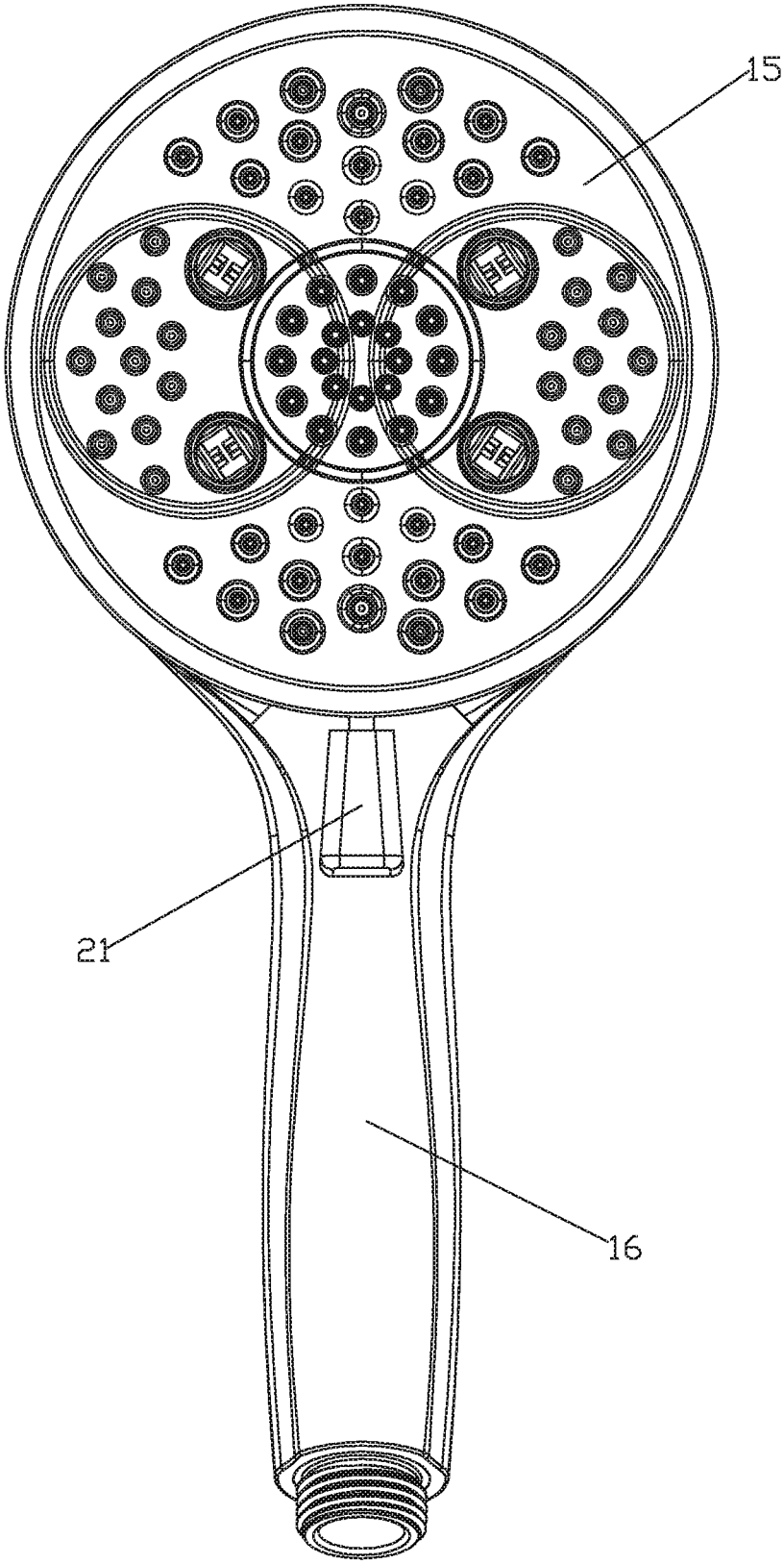
FIG. 1 illustrates a perspective view of the water outlet device of the specific embodiment.
Figure 2:
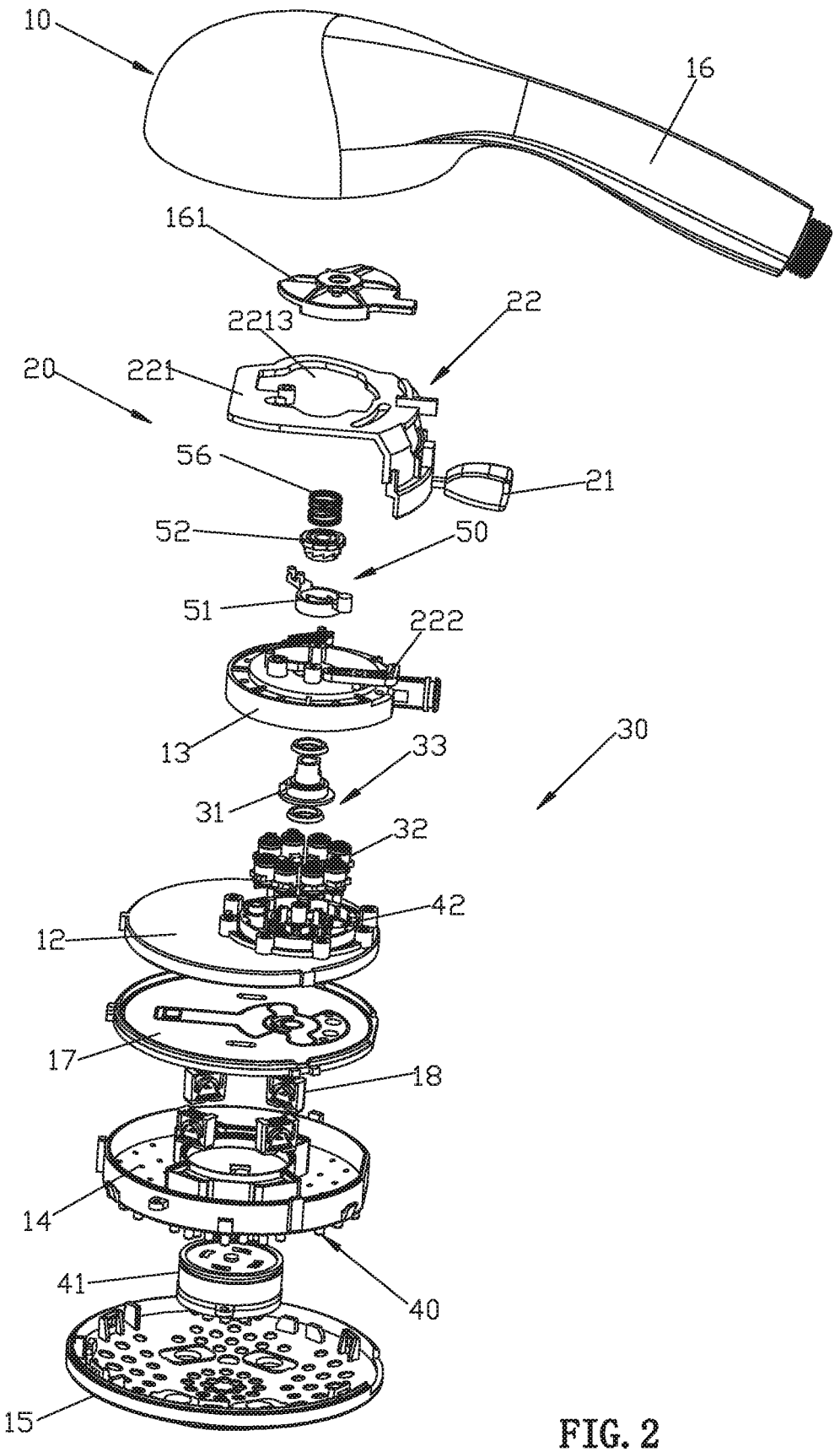
FIG. 2 illustrates an exploded perspective view of the water outlet device of the specific embodiment.
Figure 3:
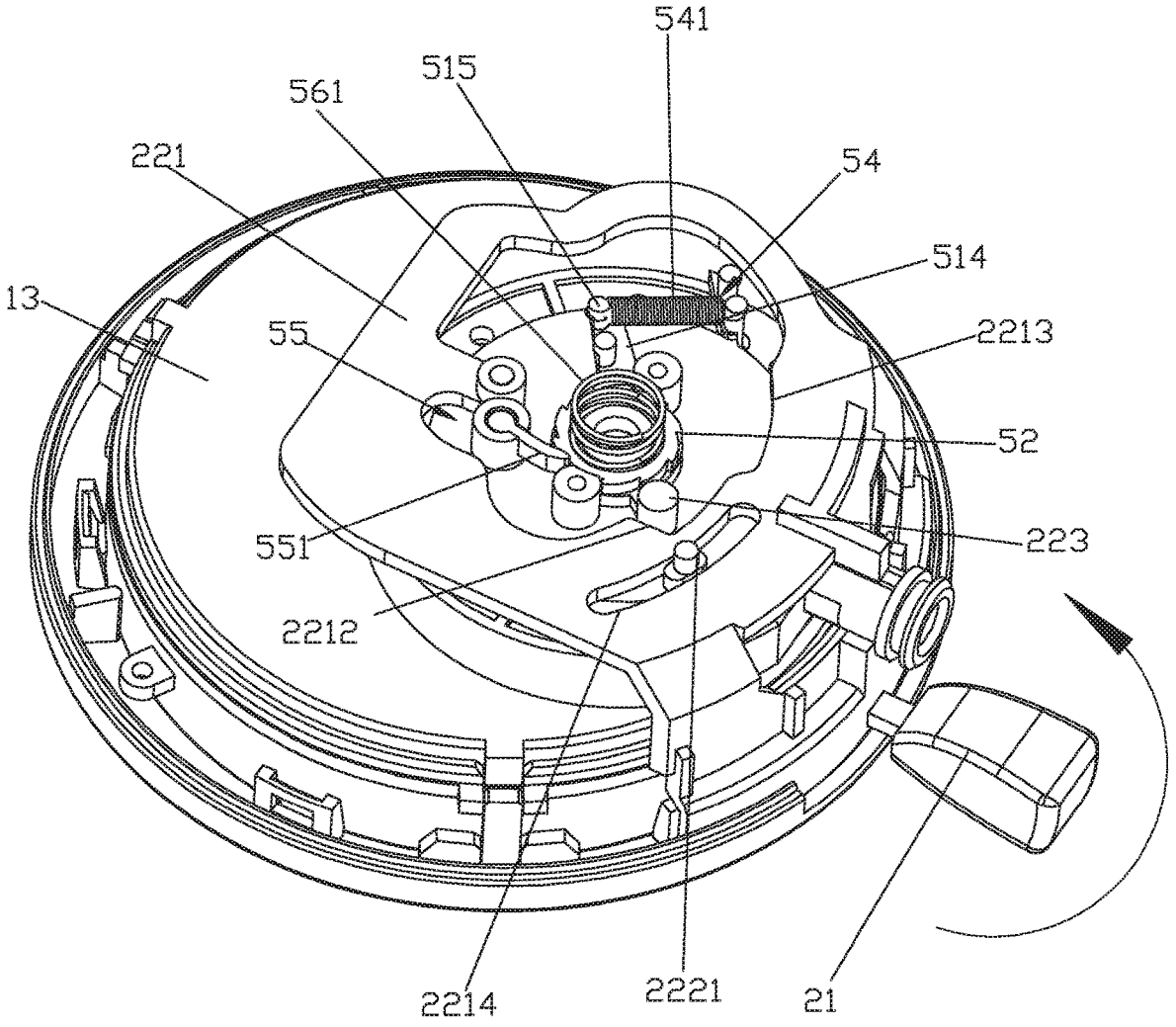
FIG. 3 illustrates a schematic view of unidirectional output of the directional control mechanism when the operating member rotates in a counterclockwise direction in the specific embodiment.
Figure 4:
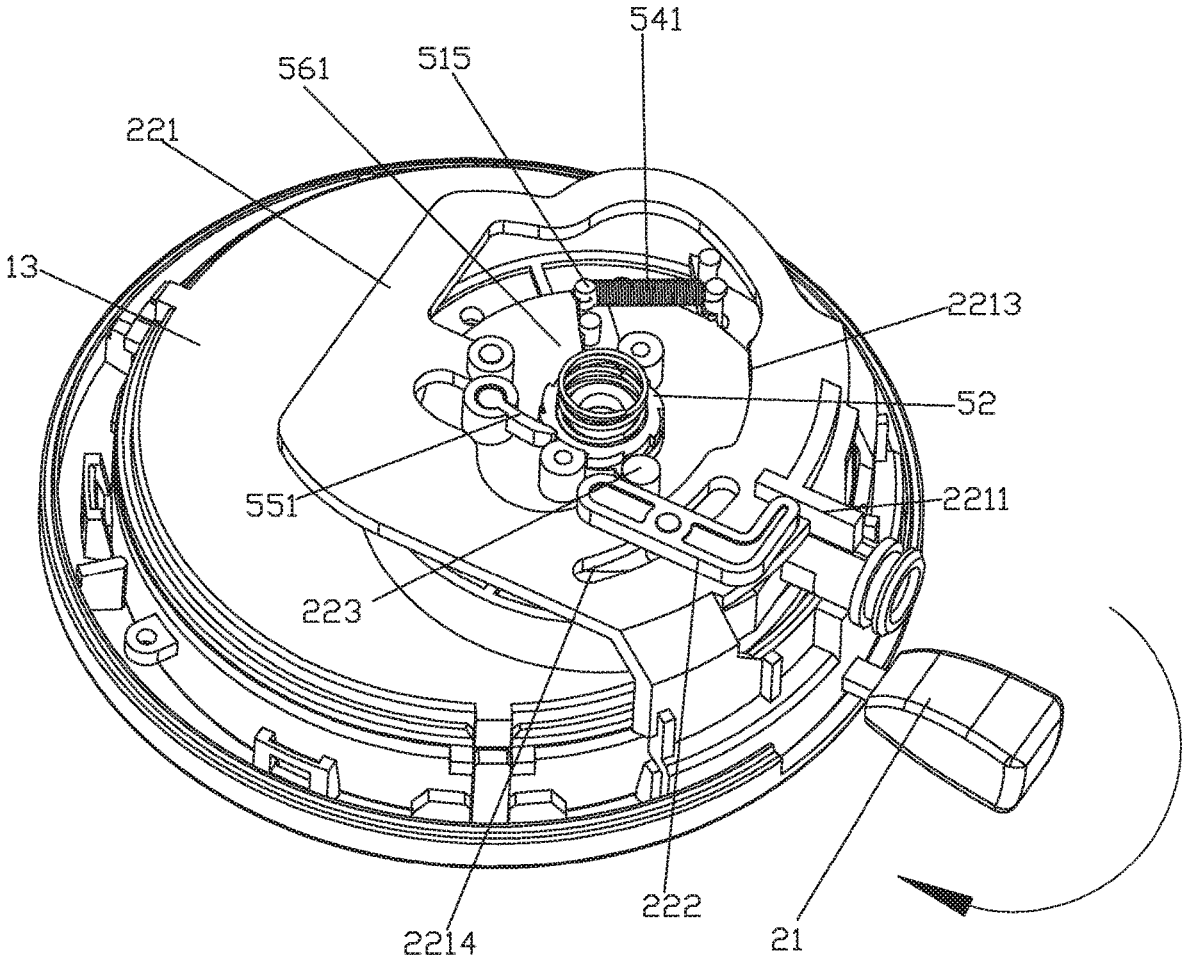
FIG. 4 illustrates a schematic view of unidirectional output of the directional control mechanism when the operating member rotates in a clockwise direction in the specific embodiment.
Figure 5:
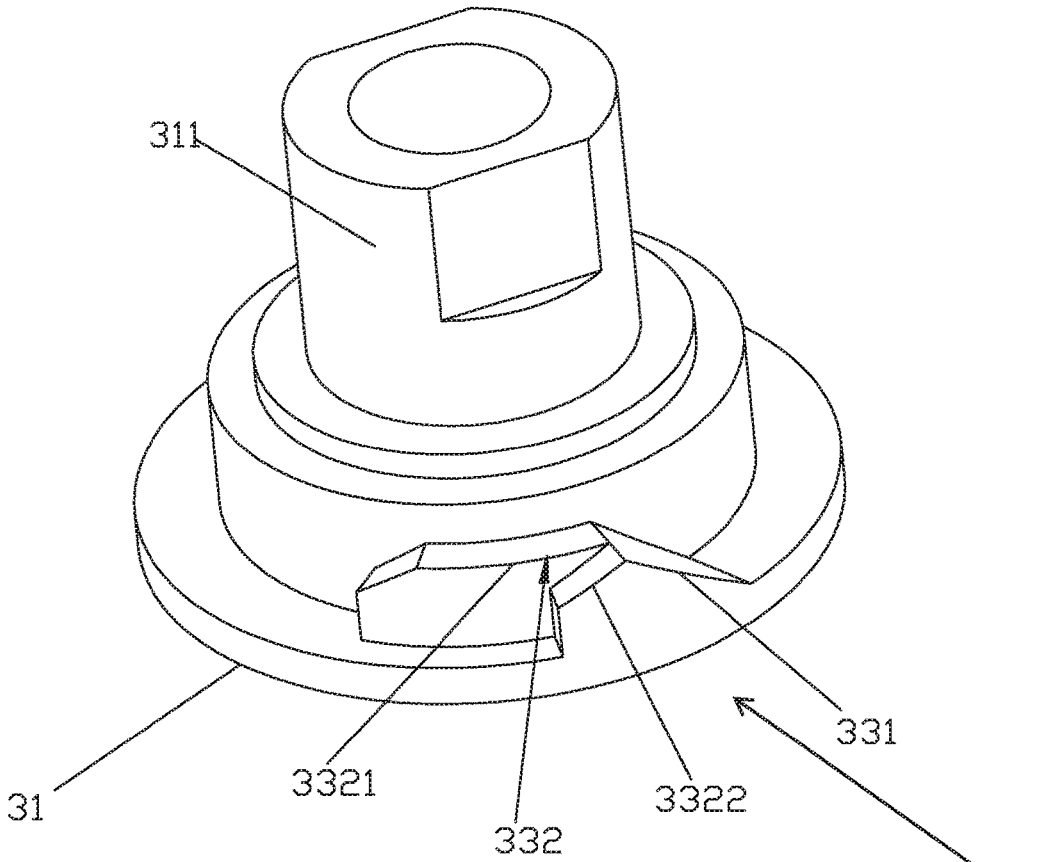
FIG. 5 illustrates a perspective view of the switching seat of the specific embodiment.
Figure 6:
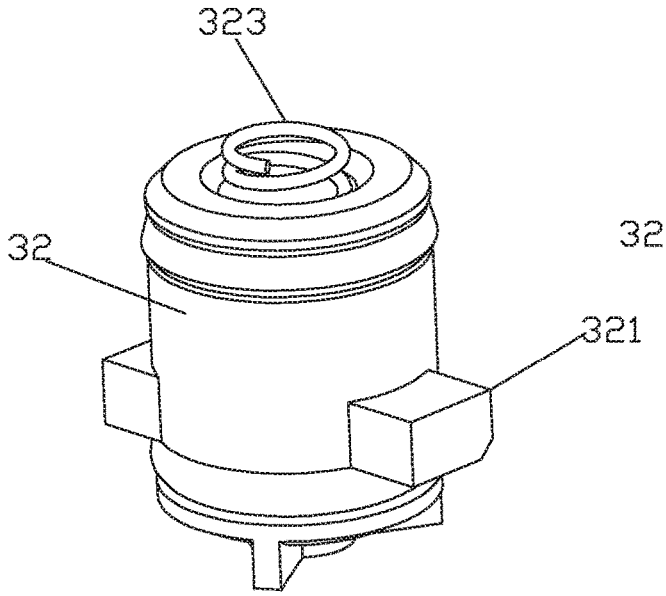
FIG. 6 illustrates a perspective view of the first sealing part of the specific embodiment.
Figure 7:
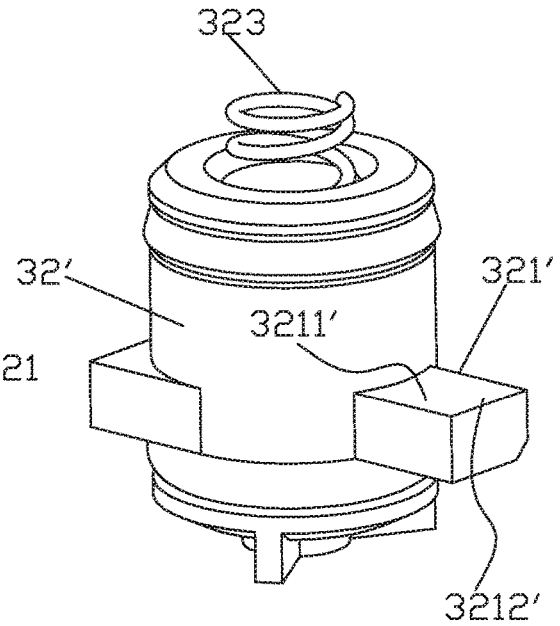
FIG. 7 illustrates a perspective view of the second sealing part of the specific embodiment.
Figure 8:
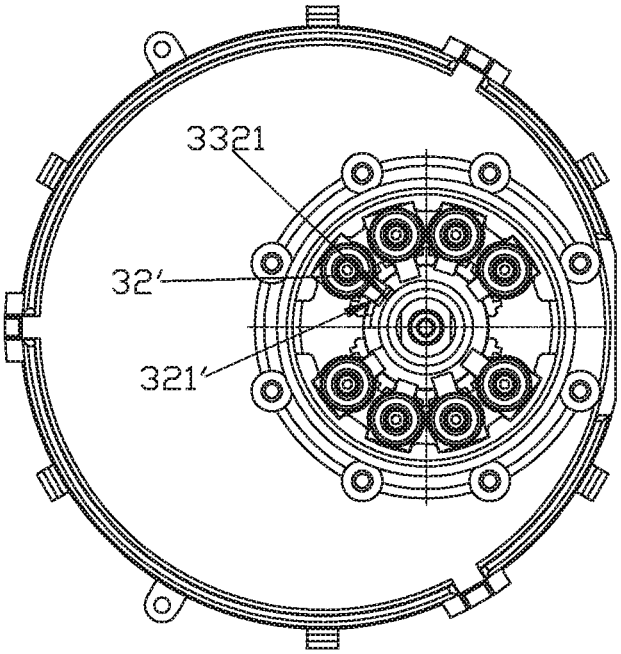
FIG. 8 illustrates a schematic view of a first state of the switching mechanism of the water outlet device of the specific embodiment.

Referring to FIGS. 1 to 19, a water outlet device comprises a body 10. The body 10 comprises a driving mechanism 20, a switching mechanism 30, and a plurality of water outlet parts 40. The switching mechanism 30 is coupled to the plurality of water outlet parts 40 to control switching of the plurality of water outlet parts 40. Each of plurality of water outlet parts 40 relates to one kind of water spray pattern. The switching comprises a switching of water spray patterns and/or a switching of water on-off. The switching of water spray patterns comprises a switching between single water spray patterns, and/or between a single water spray pattern and a mixed water spray pattern, and/or between mixed water spray patterns and etc. in the water outlet device. The driving mechanism 20 comprises an operating member 21 and a directional control mechanism 22 configured to achieve unidirectional output by bidirectional driving. The operating member 21 is rotatably connected to the body 10, so that the operation member 21 is configured to rotate relative to the body 10. The operating member 21 is connected to the directional control mechanism 22, and bidirectional movements of the operating member 21 respectively controls the directional control mechanism 22 to move in a single direction. The directional control mechanism 22 connected to the switching mechanism 30 and configured to drive the switching mechanism 30 to control the switching of the plurality of water outlet parts 40.

The directional control mechanism 22 comprises a rotating part 221, a swinging part 222, and a transmission part 223. The rotating part 221 is connected to the operating member 21. By way of example, the connection between the rotating part 221 and the operating member 21 may be fixed connection. A middle part of the swinging part 222 is configured to swing relative to the body 10. The rotating part 221 comprises a forward abutting part 2211 and a reverse abutting part 2212. When the rotating part 221 is rotated in a reverse direction, the reverse abutting part 2212 abuts the transmission part 223 such that the reverse abutting part 2212 is coupled to the transmission part 223, the forward abutting part 2211 abuts a first end of the swinging part 222, and a second end of the swinging part 222 is coupled to the transmission part 223. When the rotating part 221 is rotated in a forward direction, the forward abutting part 2211 abuts the swinging part 222, and the swinging part 222 abuts the transmission part 223. The above-mentioned forward direction and reverse direction are only for the purpose of explaining that the two directions are opposite, and the instant application is not intended to be limited to the forward direction or the reverse direction. In this embodiment, by way of example, the forward direction is clockwise and the reverse direction is counterclockwise. Therefore, in the aforementioned directional control mechanism 22, when the operating member 21 rotates in a counterclockwise direction, the operating member 21 drives the rotating part 221 to rotate in a counterclockwise direction, the reverse abutting part 2212 abuts the transmission part 223 so that the transmission part 223 swings in a counterclockwise direction. When the operating member 21 rotates in a clockwise direction, the operating member 21 drives the rotating part 221 to rotate in a clockwise direction, the reverse abutting part 2212 is driven away from the transmission part 223, the forward abutting part 2211 abuts the first end of the swinging part 222, and the second end of the swinging part 222 abuts the transmission part 223, so that the transmission part 223 swings in a counterclockwise direction. That is, whether the operating member 21 rotates in the clockwise direction or in the counterclockwise direction, the transmission part 223 swings in the counterclockwise direction.

In one embodiment, the rotating part 221 is disposed with a mounting space 2213 penetrating an upper end and a lower end of the rotating part 221, and an inner wall of the mounting space 2213 of the rotating part 221 is disposed with a step 2212. A step surface of the step 2212 defines the reverse abutting part 2212. A lug 2211 is fixedly disposed on the rotating part 221, and the lug 2211 defines the forward abutting part 2211. The rotating part 221 is disposed with an arc-shaped through groove 2214 disposed around a rotation axis of the rotating part 221. The swinging part 222 is disposed above the rotating part 221. The swinging part 222 is connected to the body 10 through a swinging shaft 2221. The swinging shaft 2221 is configured to pass through the arc-shaped through groove 2214.

An intermittent movement mechanism 50 is disposed between the directional control mechanism 22 and the switching mechanism 30. The switching mechanism 30 comprises a switching seat 31 configured to rotate relative to the body 10. The intermittent movement mechanism 50 is connected to the switching seat 31 to drive the switching seat 31 to unidirectionally rotate at a preset angle to control the switching of the plurality of water outlet parts 40. The intermittent movement mechanism 50 comprises a driving wheel 51, a driven wheel 52, and a retaining mechanism 55. The directional control mechanism 22 is connected to the driving wheel 51, the driving wheel 51 is connected to the driven wheel 52, and the driven wheel 52 is connected to the switching seat 31. Moreover, a clutch mechanism 53 is disposed between the driving wheel 51 and the driven wheel 52. When the driving wheel 51 rotates in the reverse direction, the clutch mechanism 53 is engaged, and when the driving wheel 51 rotates in the forward direction, the clutch mechanism 53 is disengaged. Further, the driving wheel 51 comprises a first ratchet 531, the driven wheel 52 comprises a second ratchet 532, and the clutch mechanism 53 is defined by the first ratchet 531 and the second ratchet 532. The water outlet device comprises an elastic mechanism 56. The elastic mechanism 56 comprises a first spring 561, which abuts a rear surface of the driven wheel 52 to couple the first ratchet 531 with the second ratchet 532. The retaining mechanism 55 comprises a stop claw 551. A third ratchet 552 is disposed on a peripheral surface of the driven wheel 52. A first end of the stop claw 551 is rotatably connected to the body 10, and a second end of the stop claw 551 is coupled with the third ratchet 552.

In one embodiment, the driving wheel 51 comprises a wheel body part 511, which is an annular structure. An inner wall of the annular structure protrudes inward to define a first ring part 512, and an upper surface of the first ring part 512 defines the first ratchet 531. The driven wheel 52 comprises a cylinder part 521, and the cylinder part 521 protrudes outward with a second ring part 522. A lower surface of the second ring part 522 defines the second ratchet 532. A disc-shaped element 523 protrudes from a rear surface (top surface) of the cylinder part 521. An outer wall of the disc-shaped element 523 defines the third ratchet 552. The cylinder part 521 is disposed within an inner hole of the wheel body part 511. The disc-shaped element 523 extends out from the inner hole of the wheel body part 511, and the first spring 561 abuts a rear surface (top surface) of the disc-shaped element 523. In this embodiment, the water outlet device further comprises a reset mechanism 54, which is connected to the driven wheel 52 of the intermittent movement mechanism 50 and the body 10.

In this embodiment: the driving wheel 51 also comprises a first protrusion 513 and a second protrusion 514 protruding from an outside surface of the wheel body part 511. The transmission part 223 is fixedly connected to the first protrusion 513, and the second protrusion 514 is fixedly disposed with at least one fixed column 515. The reset mechanism 54 comprises a pull spring 541. A first end of the pull spring 541 is connected to the at least one fixed column 515, and a second end of the pull spring 541 is connected to the body 10.

In one embodiment, the driving wheel 51, the driven wheel 52, the retaining mechanism 55, and the reset mechanism 54 are disposed in the mounting space 2213 of the rotating part 221 to make a structure of the water outlet device compact.

The plurality of water outlet parts 40 are each disposed with a water-separating hole 42. Each water-separating hole 42 is disposed with sealing parts 32, 32' configured to move in a first direction relative to the body 10. The switching of each water-separating hole 42 is controlled by movement of a corresponding one of the sealing parts 32, 32'. A peripheral wall of the switching seat 31 protrudes outward and defines a pushing part 33. The plurality of sealing parts 32, 32' are circumferentially spaced apart, and the sealing parts 32, 32' surround the switching seat 31. Each sealing part 32, 32' comprises a matching part 321, 321' configured to be engaged with the pushing part 33, and when the switching seat 31 rotates, the pushing part 33 follows the switching seat 31 to move circumferentially. The circumferential movement of the pushing part 33 drives the matching part 321, 321' to move in the first direction. The first direction intersects a plane perpendicular to an axis of rotation of the switching seat 31, which is parallel to the axis of rotation of the switching seat 31. The pushing part 33 comprises a guiding surface 331 and a supporting part 332 connected to the guiding surface 331. The supporting part 332 comprises a inner ring supporting part 3321 and an outer ring supporting part 3322 arranged radially along the axis of rotation of the switching seat 31. A central angle of the outer ring supporting part 3322 is smaller than a central angle of the inner ring supporting part 3321. The outer ring supporting part 3322 is connected at the top of the guiding surface 331, and a starting end of the outer ring supporting part 3322 is aligned with a starting end of the inner ring supporting part 3321. An ending end of the inner ring supporting part 3321 is connected at the top of the guiding surface 331. At least a first sealing part 32 and a second sealing part 32' are disposed in the plurality of sealing parts 32, 32'. The matching part of the first sealing part 32 is the first matching part 321, and the matching part of the second sealing part 32' is the second matching part 321'. A length of the second matching part 321' (the second matching part 321' comprises an inner matching area 3211' for connecting to the outer ring supporting part 3322 and an outer matching area 3212' for connecting to the inner ring supporting part 3321) extending out from the second sealing part 32' is longer than that of the first matching part 321 extending out from the first sealing part 32. The second matching part 321' is engaged with the inner ring supporting part 3321 and the outer ring supporting part 3322. The first matching part 321 is only engaged with the outer ring supporting part 3322. There is at least one first sealing part 32 and one second sealing part 32' adjacent to each other in the plurality of sealing parts 32, 32'. A central angle between the first matching part 321 of the first sealing part 32 and the second matching part 321' of the adjacent second sealing part 32' are not larger than the central angle of the inner ring supporting part 3321.

When the operating member 21 is rotated in a counterclockwise direction, the rotating part 221 rotates in a counterclockwise direction, the reverse abutting part 2212 abuts the transmission part 223, the transmission part 223 swings in a counterclockwise direction, and the driving wheel 51 rotates in a counterclockwise direction. When the operating member 21 is rotated in a clockwise direction, the rotating part 221 rotates in a clockwise direction, the forward abutting part 2211 rotates in a clockwise direction to abut the swinging part 222, the second end of swinging part 222 abuts the transmission part 223, and the transmission part 223 swings in a counterclockwise direction to drive the driving wheel 51 to rotate in a counterclockwise direction. The driving wheel 51 drives the driven wheel 52 to rotate in a counterclockwise direction, the driven wheel 52 is fixedly connected to the switching seat 31, and the switching seat 31 rotates at the preset angle in the counterclockwise direction. At the same time, a second spring can store energy. The inner ring supporting part 3321, the outer ring supporting part 3322, the first matching part 321, and the second matching part 321' are arranged on the switching seat 31 to open the seals of the sealing part 32, 32' and the corresponding water-separating hole 42 in order to realize the combination switching of any single water spray pattern, mixed water spray pattern, and water stoppage. After a user releases his/her hand, the second spring will drive the driving wheel 51 and a button to reset, and the driven wheel 52 will remain in the switching position due to the stop claw 551, thus the bidirectional resettable switching of the function is cycled.

The water outlet device of the present embodiment is resettable and enables bidirectionally switch of the operating member 21. The water outlet device has the following advantages: 1. the water outlet device can bidirectionally reset and be bidirectionally switched, which can meet the needs of left-handed and right-handed people at the same time (The water outlet devices on the market can be reset and unidirectionally switched, which does not meet the needs of both left-handed and right-handed people), and the convenience is good; 2. the water outlet device can be switched by one hand; 3. the operating stroke is short and the switching force is light, which can meet the high life test standard (150,000 times); 4. the combination of the water spray patterns is large—the water outlet device can realize any combination of single water spray patterns, mixed water spray patterns and water stoppage; and 5. complete water stoppage can be achieved.

Figure 9:
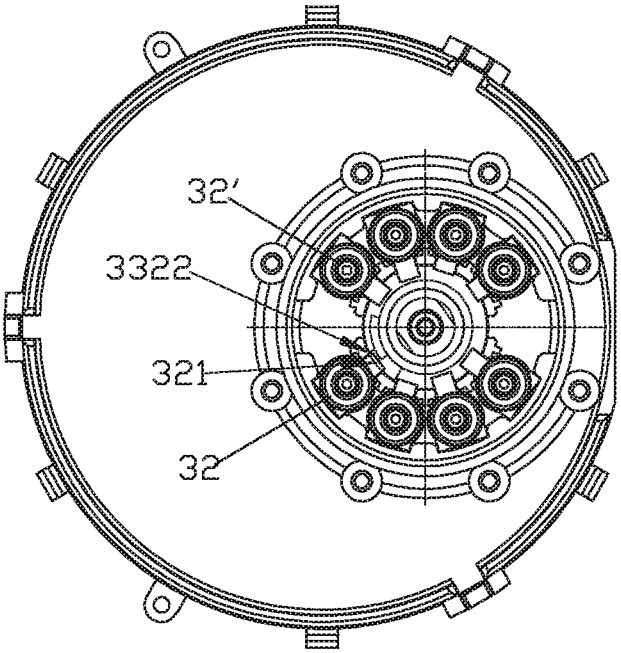
FIG. 9 illustrates a schematic view of a second state of the switching mechanism of the water outlet device of the specific embodiment.
Figure 10:
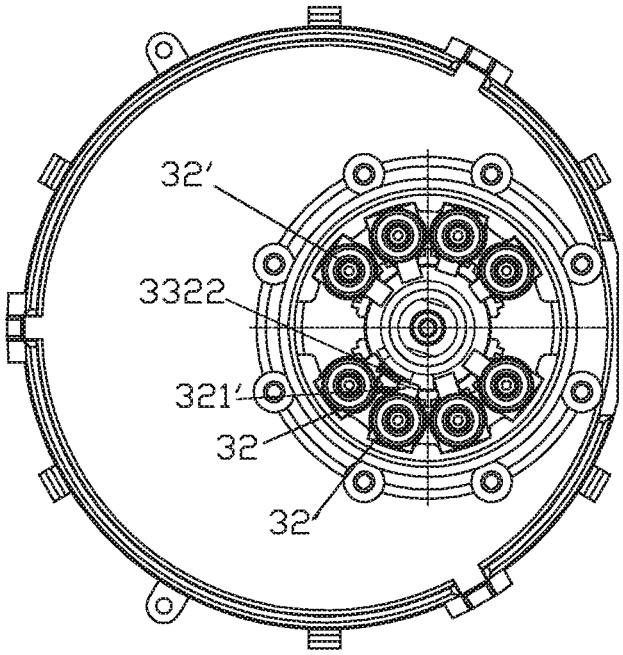
FIG. 10 illustrates a schematic view of a third state of the switching mechanism of the water outlet device of the specific embodiment.
Figure 11:
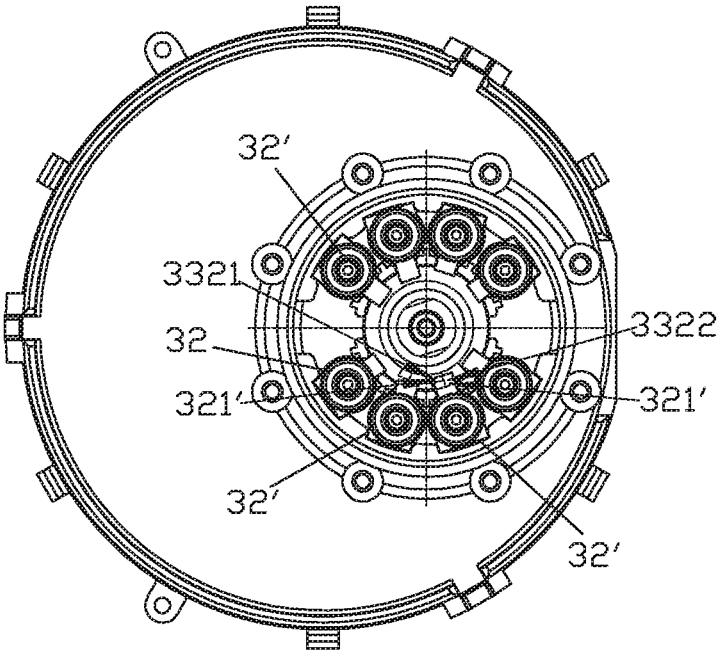
FIG. 11 illustrates a schematic view of a fourth state of the switching mechanism of the water outlet device of the specific embodiment.
Figure 12:
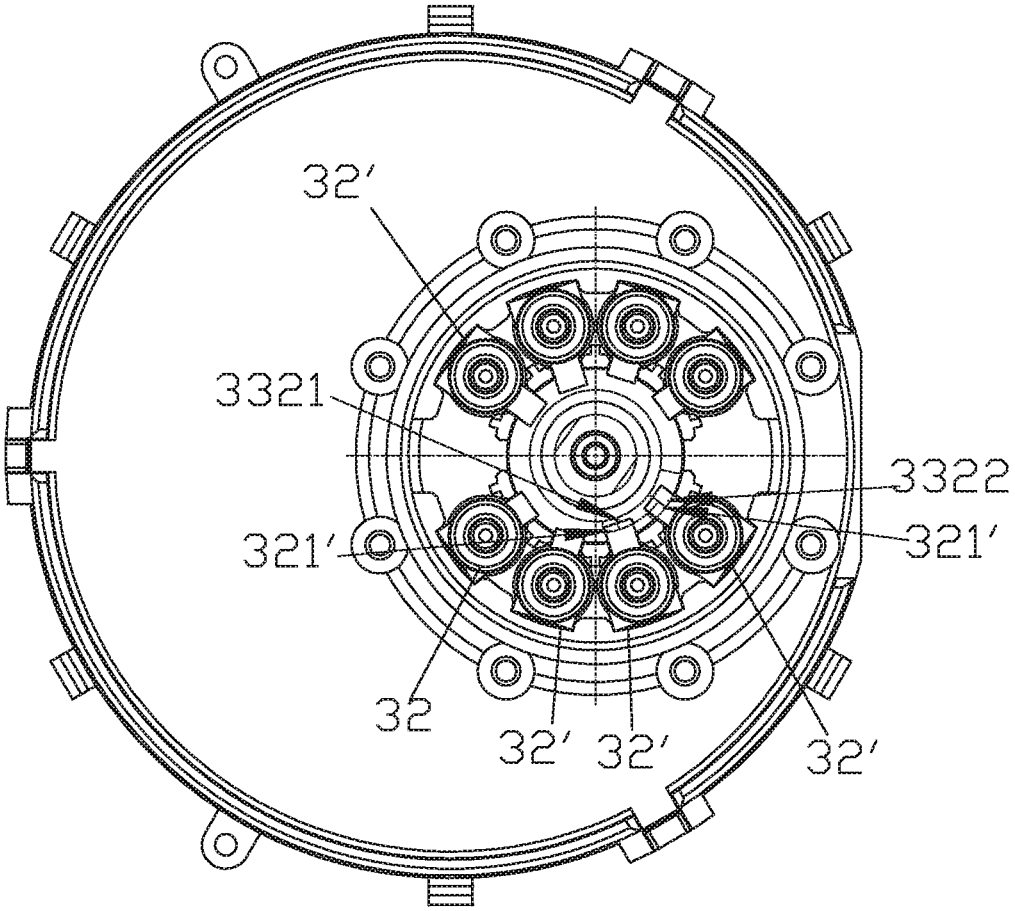
FIG. 12 illustrates a schematic view of a fifth state of the switching mechanism of the water outlet device of the specific embodiment.
Figure 13:
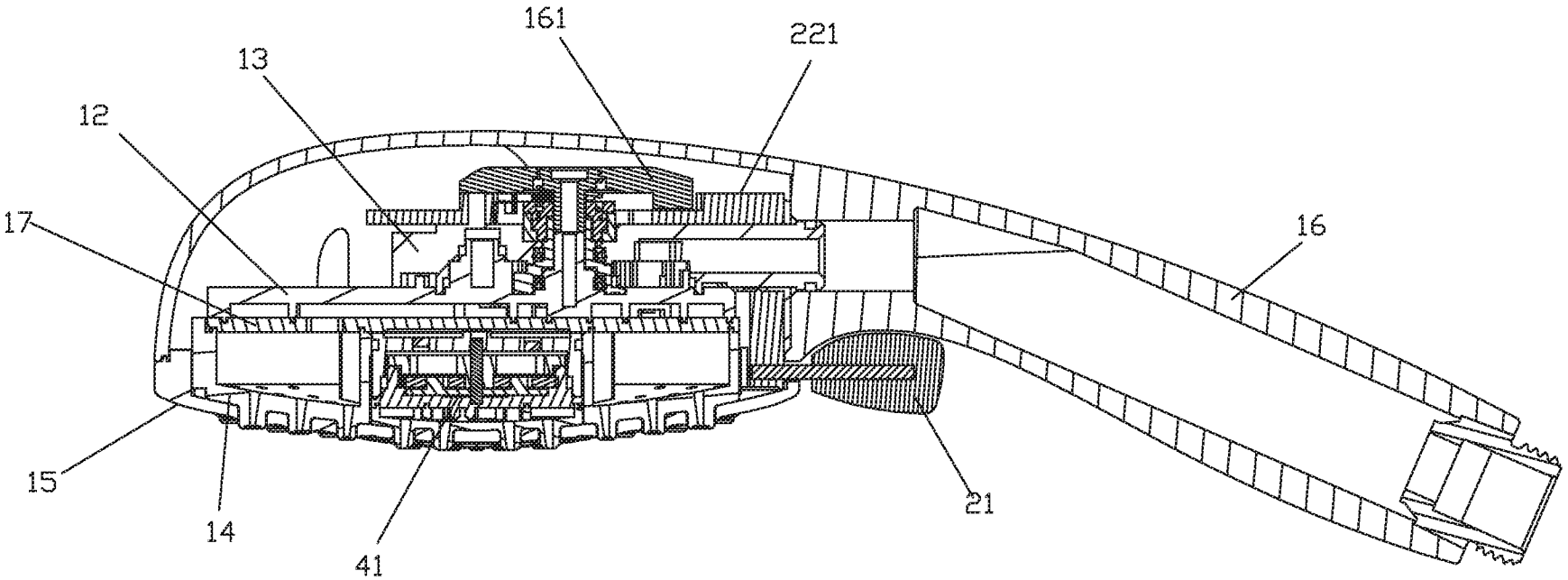
FIG. 13 illustrates a cross-sectional view of the water outlet device of the specific embodiment.
Figure 14:
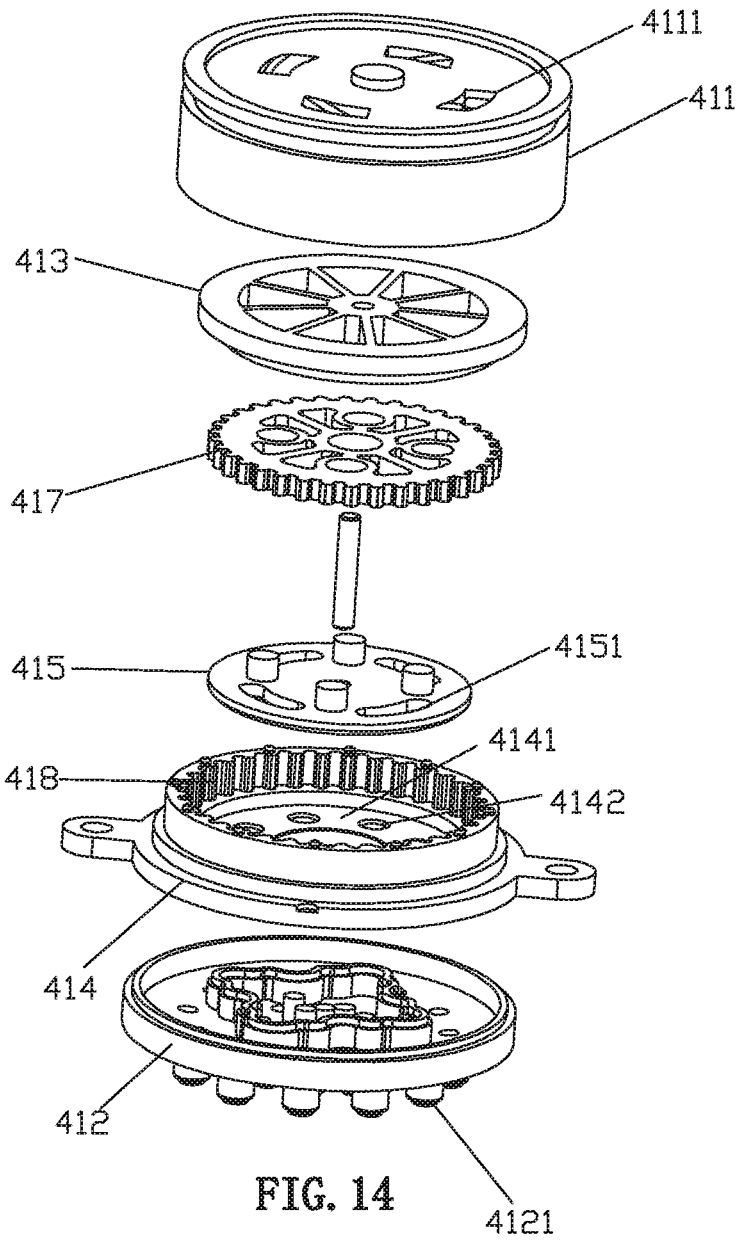
FIG. 14 illustrates an exploded perspective view of the water outlet part of the massage water spray of the water outlet device of the specific embodiment
Figures 1, 14:
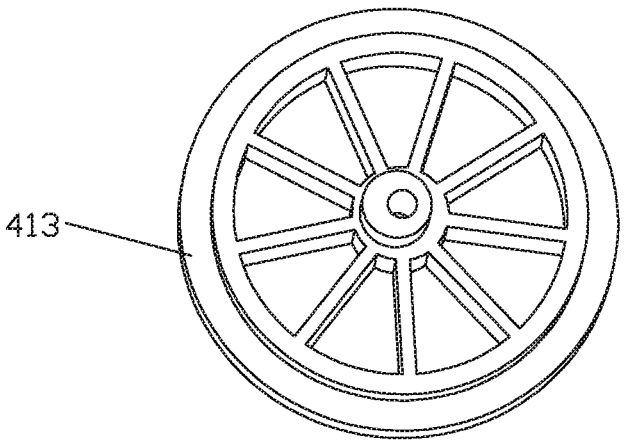
Figure 15:
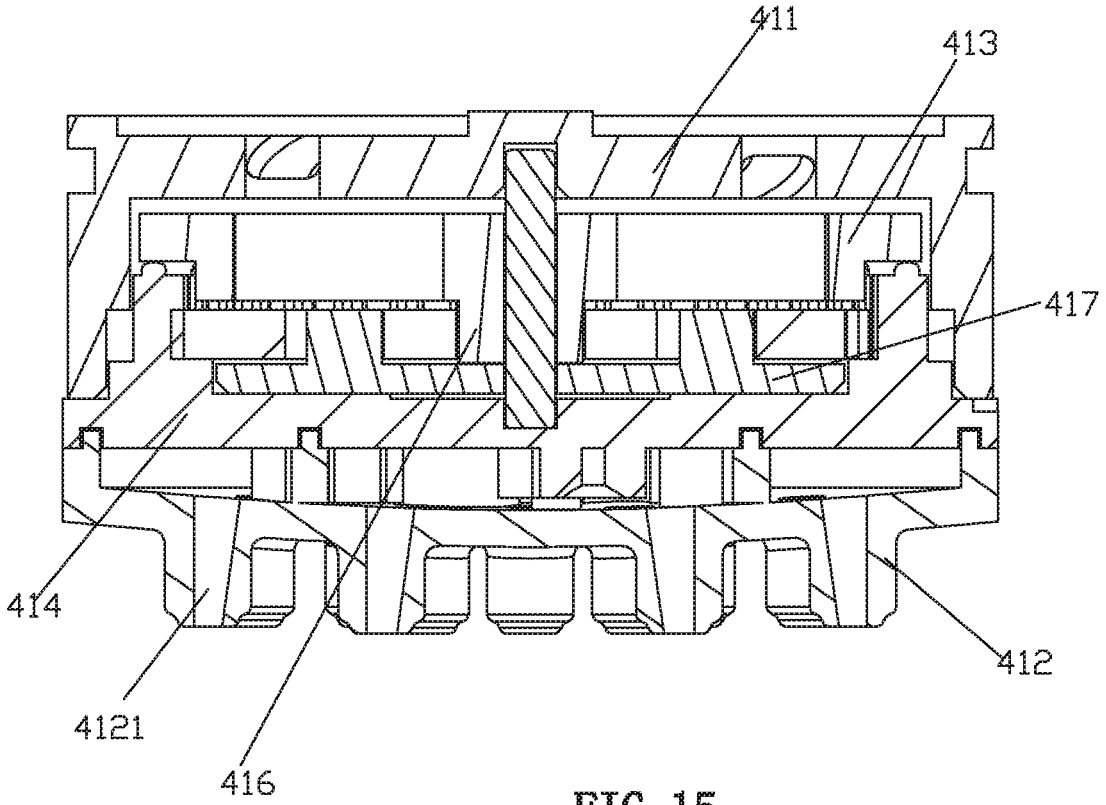
FIG. 15 illustrates a cross-sectional view of the water outlet part of the massage water spray of the water outlet device of the specific embodiment.
Figure 16:
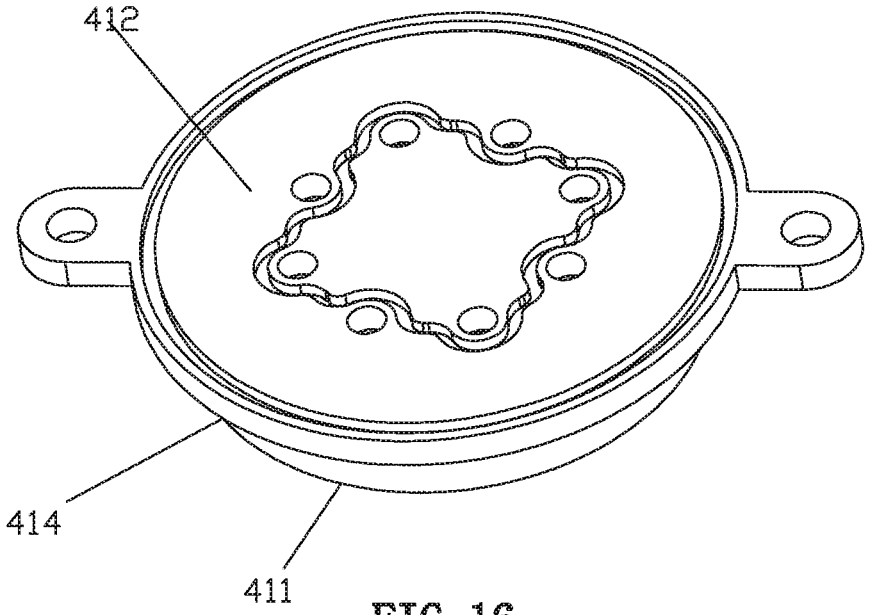
FIG. 16 illustrates a perspective view of the water outlet part of the massage water spray of the water outlet device of the specific embodiment.
Figure 17:
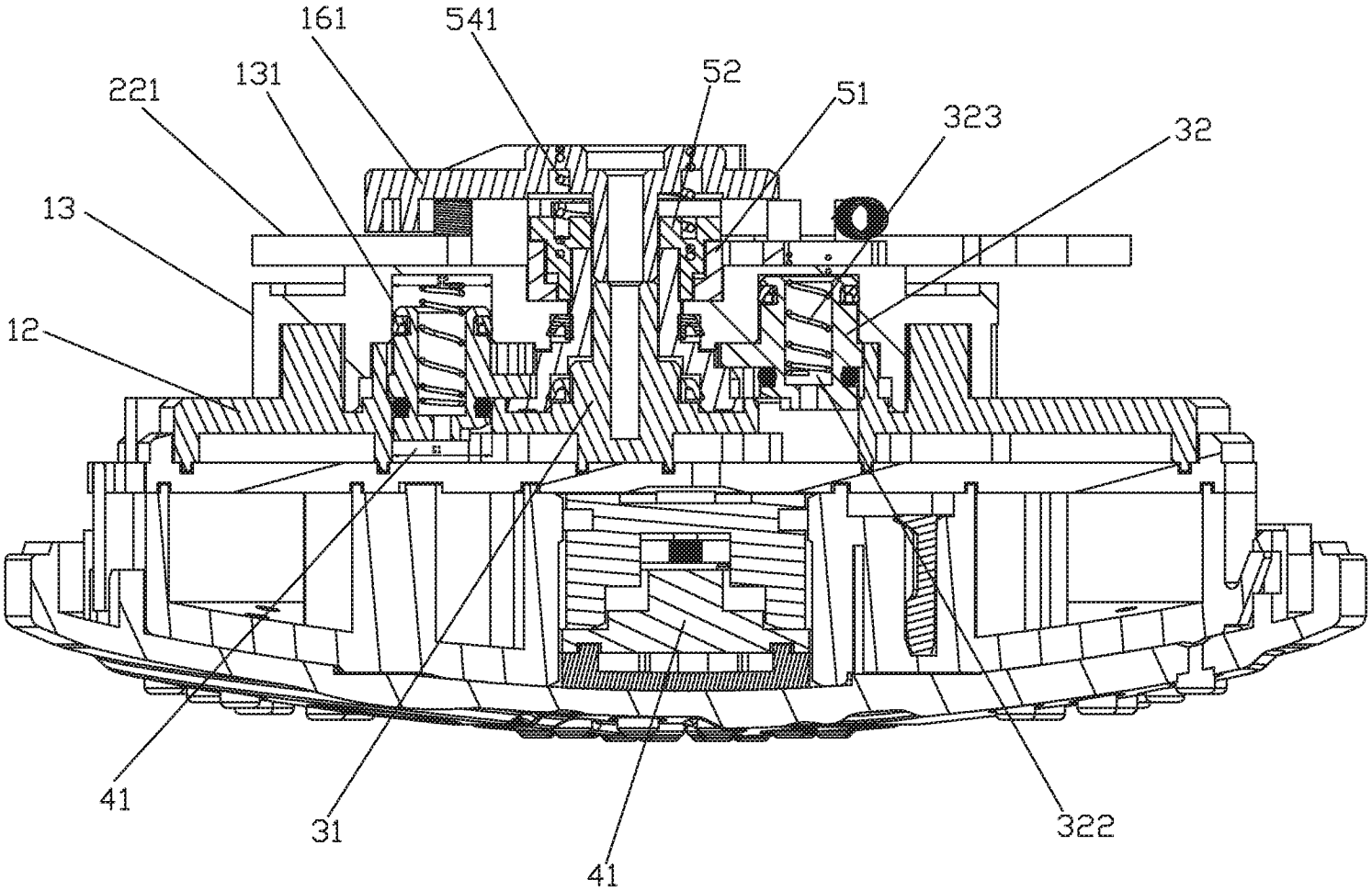
FIG. 17 illustrates a cross-sectional view of a portion of the water outlet device of the specific embodiment of the present disclosure.
Figure 18:
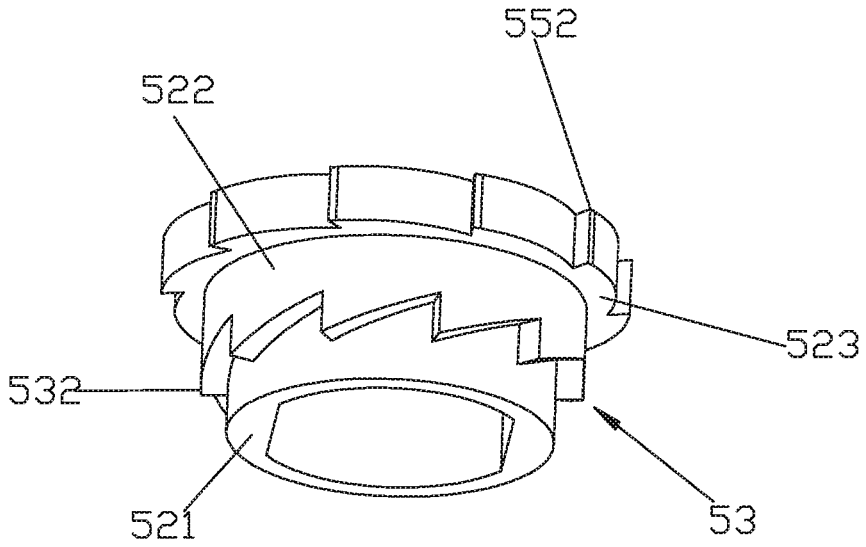
FIG. 18 illustrates a perspective view of the driven wheel of the specific embodiment.
Figure 19:
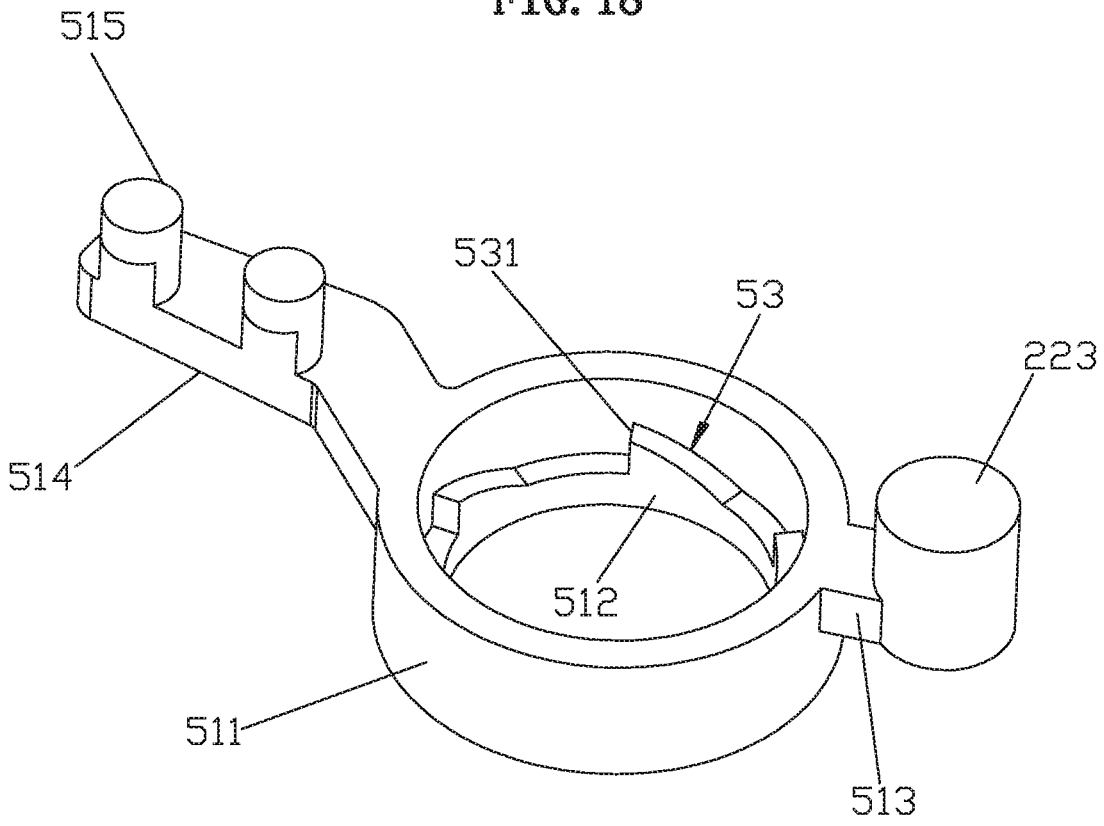
FIG. 19 illustrates a perspective view of the driving wheel of the specific embodiment.

A central angle of the first matching part 321 of the first sealing part 32 and a central angle of the second matching part 321' of the second sealing part 32' are not larger than that of the inner ring supporting part 3321. The first sealing part 32 is adjacent to the second sealing part 32', as shown in FIGS. 8 to 12. There are four water outlet parts 40. The four water outlet parts 40 are water outlet part A, water outlet part B, water outlet part C, and water outlet part D. Water outlet part A, water outlet part B, water outlet part C, and water outlet part D are in circumferential sequential arrangement. In this embodiment, with reference to FIG. 8, when the operating member 21 is pushed once, the operating member 21 rotates 36 degrees. When the operating member 21 rotates to this position, the inner ring supporting part 3321 on the switching seat 31 is engaged with the outer matching area 3212' of the sealing part 32' on the water outlet part A (which is the second sealing part 32'). At this time the water outlet part A is out of water, and the water outlet device is in a first state. With reference to FIG. 9, when the operating member 21 continues to rotate 36 degrees, the outer ring supporting part 3322 of the switching seat 31 is engaged with the first matching part 321 of the sealing part 32 of the water outlet part B (which is the first sealing part 32). At this time, the water outlet part B is out of water, and the water outlet device is in a second state. When the water-separating hole 42 of water outlet part B is a blind hole or a hole with a small diameter, the water outlet device should be in a complete water stoppage state or a small flow water outlet state. With reference to FIG. 10, when the operating member 21 continues to rotate 36 degrees, the outer ring supporting part 3322 of the switching seat 31 is engaged with the inner matching area 3211' of the sealing part 32' of the water outlet part C (which is the second sealing part 32'). At this time the water outlet part C is out of water, and the water outlet device is in the third state. With reference to FIG. 11, when the operating member 21 continues to rotate 36 degrees, the inner ring supporting part 3321 and the outer ring supporting part 3322 of the switching seat 31 are engaged with the inner matching area 3211' and the outer matching area 3212' of the sealing part 32' of the water outlet part D (which is the second sealing part 32'). At this time, the water outlet part D is out of water, and the water outlet device is in a fourth state. With reference to FIG. 12, when the operating member 21 continues to rotate 36 degrees, the inner ring supporting part 3321 and the outer ring supporting part 3322 of the switching seat 31 are engaged with the inner matching area 3211' and the outer matching area 3212' of the sealing part 32' of the water outlet part A. The inner ring supporting part 3321 of the switching seat 31 also is engaged with the outer matching area 3212' of the sealing part 32' of the water outlet part D. At this time, the water outlet part A and the water outlet part D are out of water, and the water outlet device is in a fifth state.

The body 10 is disposed with a water-separating body 12 and a fixing seat 13. The water-separating body 12 and the fixing seat 13 are sealingly and fixedly connected. The water-separating body 12 is disposed with the water-separating hole 42 of the water outlet part 40. The fixing seat 13 is disposed with a matching groove 131 corresponding to the water-separating hole 42. The sealing part 32, 32' is disposed with a through groove 322 configured to adjust water pressure equilibrium. An upper part of the through groove 322 is disposed with an enlarged hole, and a third spring 323 abutting a bottom of the matching groove 131 of the fixing seat 13 is disposed in the enlarged hole. The sealing part 32, 32' comprises an outer wall of a cylindrical body, and the matching groove 131 and the water-separating hole 42 fit within a cross section of the cylindrical body. Water shut-off state: the sealing part 32, 32' is in an engaged state S1=S2 (not labeled in the drawing), and the sealing part 32, 32' is not subjected water pressure. Therefore, when the waterway under the sealing part 32, 32' needs to be opened, the sealing part 32, 32' only needs to overcome a force of the third spring 323 of the sealing part 32, 32'. Water on state: water enters an upper chamber defined by the enlarged hole through the through groove 322 below the sealing part 32, 32', filling the whole sealing part 32, 32' with water. Therefore, during the water on state, the sealing part 32, 32' is not subjected to water pressure. When the supporting part 332 of the switching seat 31 disengages with the sealing part 32, 32', the sealing part 32, 32' is reset to the water shut-off state due to the force of the third spring 323. The sealing part 32, 32' is both in a water pressure equilibrium state when it is in a water on state or in a water shut-off state.

The water outlet parts 40 comprises four groups of water outlet parts. Each group of four groups of water outlet parts 40 comprises two water outlet parts 40. The two water outlet parts 40 of each group are radially symmetrically arranged relative to the axis of rotation of the switching seat 31. The water spray of one group of the water outlet parts 40 is massage water spray. The water outlet part 40 comprises a water outlet mechanism 41. The water outlet mechanism 41 comprises a first inclined water body 411, an internal gear part 414, and a small cover 412. The internal gear part 414 comprises an internal gear 418. The first inclined water body 411 and the internal gear part 414 are fixedly connected together, and an eccentric impeller 413 and a water-separating disc 415 are disposed inside of the first inclined water body 411 and the internal gear part 414. The eccentric impeller 413 is configured to rotate relative to the first inclined water body 411 and the internal gear part 414 while disposed inside of the first inclined water body 411 and the internal gear part 414. The eccentric impeller 413 comprises an eccentric pin 416 (eccentrically arranged relative to an axis of rotation of the eccentric impeller 413). The eccentric pin 416 is connected to an external gear 417. The eccentric impeller 413, the external gear 417, and the internal gear 418 constitute an intermittent movement mechanism with few teeth difference. The eccentric impeller 413 is an input component and the external gear 417 is an output component. A center axis of the water-separating disc 415 is coaxial with a center axis of the internal gear 418, and four protrusions arranged on a circumference of the water-separating disc 415 are inserted into four through holes corresponding to the external gear 417. A diameter of the through holes is larger than a diameter of the protrusions. If the diameter of the through holes of the external gear 417 is D, the diameter of the protrusions of the water-separating disc 415 is d, and an eccentricity of the eccentric pin 416 with respect to the center axis of the internal gear 418 is a, then D/2-d/2=a. The water-separating disc 415 is disposed with at least one water inlet hole 4151. The internal gear part 414 comprises an end plate 4141 sealingly and fixedly connected to a lower circumference of the internal gear 418. The end plate 4141 is disposed with at least one water outlet hole 4142, and the small cover 412 is fixedly disposed to a bottom surface of the internal gear part 414. The small cover 412 is disposed with at least one water outlet 4121 aligning with the at least one water outlet hole 4142. Water flows out of at least one inclined water hole 4111 of the first inclined water body 411 and impacts the eccentric impeller 413 to drive the eccentric impeller 413 to rotate. The eccentric pin 416 rotates around an axis of rotation of the eccentric impeller 413. The eccentric pin 416 drives the external gear 417 to rotate around the axis of rotation of eccentric impeller 413. The external gear 417 drives the protrusions extending through the through holes of the water-separating disc 415 to rotate, thereby driving the water-separating disc 415 to rotate so that the at least one water inlet hole 4151 cyclically aligned with the at least one water outlet hole 4142, causing the group of the water outlet parts to discharge a massage water spray. After deceleration, the external gear 417 drives the water-separating disc 415 to rotate, and the four water inlet holes 4151 disposed on the water-separating disc 415 are intermittently aligned with or blocked with the corresponding inner and outer water outlet holes on the internal gear 418 to charge internal and external intermittent massage water. The few teeth difference transmission realizes a switching of the massage water between the inner ring and outer ring (a height of the inner core is low and a noise is low).

In one embodiment, the water outlet device is a shower head. The body 10 of the shower head also comprises a surface cover 14, a decorative cover 15, a body portion 16, and a second inclined water body 17, which are fixedly disposed under the water-separating body 12. The surface cover 14 is fixedly disposed under the second inclined water body 17, and the decorative cover 15 is fixedly disposed on the surface cover 14. The plurality of water outlet parts 40 are equipped with at least one hydrodynamic core 18, which is engaged with the second inclined water body 17, and the body portion 16 is fixedly connected to the surface cover 14. Preferably, the body portion 16 also comprises a spring seat 161 matching with the first spring 561. The rotating part 221 is rotatably connected to the fixing seat 13. The first spring 561 is connected to the fixing seat 13 and the driven wheel 52, and the stop claw 551 is connected to the fixing seat 13. The switching seat 31 comprises a rotary shaft 311. The switching seat 31 is between the fixing seat 13 and the water-separating body 12 and the rotary shaft 311 extends out over the fixing seat 13 and is fixedly disposed on the driven wheel 52.

It will be apparent to those skilled in the art that various modifications and variation can be made in the present disclosure without departing from the spirit or scope of the invention. Thus, it is intended that the present disclosure cover the modifications and variations of this invention provided they come within the scope of the appended claims and their equivalents.

What is claimed is:

1. A water outlet device, comprising:

a body comprising a driving mechanism, a switching mechanism, and a plurality of water outlet parts, wherein:

the switching mechanism is coupled with the plurality of water outlet parts to control switching of the plurality of water outlet parts, the driving mechanism comprises an operating member and a directional control mechanism, the operating member is movably connected to the body, the operating member is connected to the directional control mechanism, bidirectional movements of the operating member respectively controls the directional control mechanism to move in a single direction, and the directional control mechanism is connected to the switching mechanism and configured to drive the switching mechanism to control switching of the plurality of water outlet parts.

2. The water outlet device according to claim 1, wherein the operating member is configured to rotate relative to the body.

3. The water outlet device according to claim 1, wherein:

the directional control mechanism comprises a rotating part, a swinging part, and a transmission part, the rotating part is connected to the operating member, a middle part of the swinging part is configured to swing relative to the body, the rotating part comprises a forward abutting part and a reverse abutting part, the reverse abutting part is coupled to the transmission part, when the rotating part is rotated in a reverse direction, the reverse abutting part abuts the transmission part, the forward abutting part abuts a first end of the swinging part, and a second end of the swinging part is coupled to the transmission part, and when the rotating part is rotated in a forward direction, the forward abutting part abuts the swinging part and the swinging part abuts the transmission part.

4. The water outlet device according to claim 3, wherein:

the rotating part is disposed with an arc-shaped through groove disposed around an axis of rotation of the rotating part, and a swinging shaft of the swinging part passes through the arc-shaped through groove.

5. The water outlet device according to claim 1, wherein an intermittent movement mechanism is disposed between the directional control mechanism and the switching mechanism.

6. The water outlet device according to claim 5, wherein:

the switching mechanism comprises a switching seat configured to rotate relative to the body, and the intermittent movement mechanism is connected to the switching seat to drive the switching seat to rotate to control the switching of the plurality of water outlet parts.

7. The water outlet device according to claim 5, wherein:

the switching mechanism comprises a switching seat configured to rotate relative to the body, and the intermittent movement mechanism is connected to the switching seat to drive the switching seat to unidirectionally rotate at a preset angle to control the switching of the plurality of water outlet parts.

8. The water outlet device according to claim 6, wherein:

the intermittent movement mechanism comprises a driving wheel and a driven wheel, the directional control mechanism is connected to the driving wheel, the driving wheel is connected to the driven wheel, and the driven wheel is connected to the switching seat.

9. The water outlet device according to claim 8, wherein:

a clutch mechanism is disposed between the driving wheel and the driven wheel, when the driving wheel rotates in a reverse direction, the clutch mechanism is engaged, and when the driving wheel rotates in a forward direction, the clutch mechanism is disengaged.

10. The water outlet device according to claim 9, wherein:

the driving wheel comprises a first ratchet, the driven wheel comprises a second ratchet, the clutch mechanism is defined by the first ratchet and the second ratchet, and an elastic mechanism connects to the driving wheel or the driven wheel to couple the first ratchet with the second ratchet.

11. The water outlet device according to claim 8, wherein:

the intermittent movement mechanism further comprises a retaining mechanism, the retaining mechanism comprises a stop claw, a peripheral surface of the driven wheel comprises a third ratchet, a first end of the stop claw is rotatably connected to the body, and a second end of the stop claw is coupled with the third ratchet.

12. The water outlet device according to claim 5, further comprising:

a reset mechanism connected to the intermittent movement mechanism and the body.

13. The water outlet device according to claim 8, further comprising:

a reset mechanism connected to the driving wheel and the body.

14. The water outlet device according to claim 3, wherein:

an intermittent movement mechanism is disposed between the directional control mechanism and the switching mechanism, the intermittent movement mechanism comprises a driving wheel, and the driving wheel is fixed relative to the transmission part.

15. The water outlet device according to claim 8, wherein:

the driving wheel comprises a wheel body part and a first protrusion protruding from the wheel body part, and the directional control mechanism comprises a transmission part fixedly connected to the first protrusion.

16. The water outlet device according to claim 1, comprising:

a plurality of sealing parts, wherein:

the switching mechanism comprises a switching seat, each water outlet part of the plurality of water outlet parts is disposed with a water-separating hole, each water-separating hole is disposed with a corresponding sealing part of the plurality of sealing parts configured to move in a first direction relative to the body, switching of each water-separating hole is controlled by movement of the corresponding sealing part, a peripheral wall of the switching seat protrudes outward to define a pushing part, the plurality of sealing parts are circumferentially spaced apart and surround the switching seat, the plurality of sealing parts are disposed with a plurality of matching parts configured to be engaged with the pushing part, and when the switching seat rotates:

the pushing part follows the switching seat to move circumferentially, circumferential movement of the pushing part drives a corresponding matching part of the plurality of matching parts to move in the first direction, and the first direction intersects a plane perpendicular to an axis of rotation of the switching seat.

17. The water outlet device according to claim 16, wherein:

the pushing part comprises a guiding surface and a supporting part connected to the guiding surface, the supporting part comprises an inner ring supporting part and an outer ring supporting part arranged radially along the axis of rotation of the switching seat, a central angle of the outer ring supporting part is smaller than a central angle of the inner ring supporting part, the plurality of sealing parts comprises at least a first sealing part and a second sealing part, the first sealing part comprises a first matching part of the plurality of matching parts, the second sealing part comprises a second matching part of the plurality of matching parts, a length of the second matching part extending out from the second sealing part is longer than a length of the first matching part extending out from the first sealing part, the second matching part is engaged with the inner ring supporting part and the outer ring supporting part, and the first matching part is only engaged with the outer ring supporting part.

18. The water outlet device according to claim 17, wherein the supporting part is connected to a top of the guiding surface.

19. The water outlet device according to claim 17, wherein a first end of the inner ring supporting part is aligned with a first end of the outer ring supporting part.

20. The water outlet device according to claim 17, wherein:

the first sealing part is adjacent to the second sealing part, a central angle between the first matching part of the first sealing part and the second matching part of the second sealing part is not larger than the central angle of the inner ring supporting part.

21. A water outlet device, comprising:

a body comprising a switching mechanism, a driving mechanism configured to drive the switching mechanism, a plurality of sealing parts, and a plurality of water outlet parts, wherein:

the switching mechanism comprises a switching seat, each water outlet part of the plurality of water outlet parts is disposed with a water-separating hole, each water-separating hole is disposed with a corresponding sealing part of the plurality of sealing parts configured to move in a first direction relative to the body, switching of each water-separating hole is controlled by movement of the corresponding sealing part, a peripheral wall of the switching seat protrudes outward to define a pushing part, the plurality of sealing parts are circumferentially spaced apart and surround the switching seat, the plurality of sealing parts are disposed with a plurality of matching parts configured to be engaged with the pushing part, when the switching seat rotates:

the pushing part follows the switching seat to move circumferentially, circumferential movement of the pushing part drives a corresponding matching part of the plurality of matching parts to move in the first direction, the first direction intersects a plane perpendicular to an axis of rotation of the switching seat, the pushing part comprises a guiding surface and a supporting part connected to the guiding surface, the supporting part comprises an inner ring supporting part and an outer ring supporting part arranged radially along the axis of rotation of the switching seat, a central angle of the outer ring supporting part is smaller than a central angle of the inner ring supporting part, the plurality of sealing parts comprises at least a first sealing part and a second sealing part, the first sealing part comprises a first matching part of the plurality of matching parts, the second sealing part comprises a second matching part of the plurality of matching parts, a length of the second matching part extending out from the second sealing part is longer than a length of the first matching part extending out from the first sealing part, the second matching part is engaged with the inner ring supporting part and the outer ring supporting part, and the first matching part is only engaged with the outer ring supporting part.

22. A driving mechanism for a water outlet device, wherein:

the driving mechanism comprises an operating member and a directional control mechanism, the operating member is movably connected to a body of the water outlet device, the operating member is connected to the directional control mechanism, bidirectional movements of the operating member respectively controls the directional control mechanism to move in a single direction, and the directional control mechanism is connected to a switching mechanism of the body and configured to drive the switching mechanism.

* * * * *